US005117529A

United States Patent [19]

Ohta

[11] Patent Number: 5,117,529

[45] Date of Patent: Jun. 2, 1992

[54] COMBINATION ROLLER AND COMBINATION PAINTING METHOD USING THE COMBINATION ROLLER

[75] Inventor: Tanetugu Ohta, Yamanashi, Japan

[73] Assignee: Yugen Kaisha Ohta Kogyo, Kohfu, Japan

[21] Appl. No.: 470,494

[22] Filed: Jan. 26, 1990

[30] Foreign Application Priority Data

Jul. 5, 1989 [JP] Japan ..... 1-79321[U]
Aug. 25, 1989 [JP] Japan ..... 1-219303

[51] Int. Cl.[5] ..... B05C 17/02

[52] U.S. Cl. ..... 15/230.11; 15/230.16; 15/235; 29/110.5; 29/121.1; 29/132

[58] Field of Search ..... 15/230.11, 235, 230.16, 15/210.5; 118/102; 427/428; 29/110.5, 121.1, 132

[56] References Cited

U.S. PATENT DOCUMENTS

| | | | |
|---|---|---|---|
| 639,287 | 12/1899 | Raymond | 24/590 |
| 1,003,647 | 9/1911 | Piper | 15/230.16 |
| 1,413,082 | 4/1922 | Weinrich | 24/590 |
| 2,778,050 | 1/1957 | Meinhardt | 15/230.11 |
| 3,246,357 | 4/1966 | Ammons | 15/230.11 |
| 3,536,037 | 10/1970 | Mortellito | 15/230.11 |
| 4,100,007 | 7/1978 | van Zeeland | 15/230.11 |
| 4,930,179 | 6/1990 | Wright et al. | 15/230.11 |

FOREIGN PATENT DOCUMENTS

| | | | |
|---|---|---|---|
| 703632 | 2/1954 | United Kingdom | 15/230.11 |

*Primary Examiner*—Philip R. Coe
*Assistant Examiner*—Patrick Brinson
*Attorney, Agent, or Firm*—Schwartz & Weinrieb

[57] ABSTRACT

An elastic sheet having many kinds of shapes is secured upon the surface of a roller so as to form a combination roller which can create a painted pattern when the roller is rotated such that the paint is thrown onto a surface to be painted by means of centrifugal force whereby the spray splashed thereby creates a pattern. A pattern having different thicknesses of paints and widths of lines can thus be created as a unit of a predetermined repetitive pattern.

20 Claims, 5 Drawing Sheets

COMBINATION ROLLER AND COMBINATION PAINTING METHOD USING THE COMBINATION ROLLER

FIELD OF THE INVENTION

This invention relates generally to a combination roller and a combination painting method using the combination roller and more particularly, to a combination roller which can create various complicated and repetitive patterns without a high level of technology, and to a combination painting method using the combination roller which can create various colorful and differing patterns in connection with the painting of the inside or outside of a building and therefore can paint, for example, marble pattern, or the like, upon an inside or outside surface of a building by means of a simple operation.

BACKGROUND OF THE INVENTION

A combination painting method aims to embellish an interior wall of a building or a furnishing. In the first stage of the combination painting method, a newspaper or brownpaper, or the like, crumpled into a ball by one's hands so as to have an adequate shape was used. Many improvements upon the combination painting method have been accomplished and at the present it is usual to select a sponge having good solvent resistance among many kinds of sponges on the market and to provide with sponge with uneven or jagged surfaces by appropriately: cutting the surfaces of the sponge and to subsequently paint a wall of a building or the like, by providing the surface of the sponge with paint and then pushing the surface of the sponge onto the wall of the building or the like.

However, the conventional painting methods are extremely inefficient, and the kinds of patterns which can be selected in accordance with the combination painting methods are quite limited.

The inventior of the present invention has especially noted tha fact that a roller particularly developed for the exclusive use for painting by means of conventional combination painting methods has never been introduced onto the market, and accordingly, has developed an exclusive combination roller for practicing the combination painting method and which satisfies the following conditions (a)~(e), and, still further, has realized that a new pattern can be created by using this combination roller. This invention was thus completed under the foregoing circumstances, and achieves the following objectives:

(a) A combination method can be created easily and quickly, and anyone can operate the roller easily without a high level of technology.

(b) A combination pattern having a predetermined repetitive pattern resolving pattern monotony problems can be created.

(c) Many kinds of patterns and colors can be selected and painted by exchanging the surface of the roller.

(d) Any kinds of paints can be used.

(e) Colorful patterns can be created.

SUMMARY OF THE INVENTION

Accordingly, it is an object of the present invention to provide a combination roller and a combination painting method by using the combination roller in which the above problems are solved by revolving the combination roller such that edges of a number of elastic sheets having a predetermined shape upon the surface of the roller revolve about the axis of the roller at such a speed that the edge of each elastic sheet is thrown by means centrifugal force onto a surface to be painted.

Namely, each elastic sheet is pressed with considerable amount of force by means of the roller, or thrown by means of the centrifugal force onto the surface to be painted by revolving the combination roller of this invention, and a spray of paint splashed thereby creates a natural pattern upon the surface. In particular, a tasteful pattern having strong and weak varying lines can be created by revolving the combination roller at such a speed that each elastic sheet is thrown onto the surface by means of the centrifugal force.

According to the combination painting method using the combination roller of the invention, the following principle is utilized. The elastic body having many kinds of shapes formed upon the surface of the roller creates a pattern when disposed or fixed upon the roller or thrown upon the surface to be painted under the influence of the centrifugal force, and the spray splashed thereby creates a pattern. A pattern having different thickness of paints and widths of lines can thus be created as a unit of predetermined repetitive pattern.

BRIEF DESCRIPTION OF THE DRAWINGS

The invention will be explained in more detail by means of the following detailed description, when considered in conjunction with the appended drawings, in which like reference characters designate like or corresponding parts throughout the several views, and wherein.

DESCRIPTION OF THE ILLUSTRATED EMBODIMENTS

An embodiment of the combination painting method using the combination roller of the invention will be described in accordance with the drawings.

Figure 1:
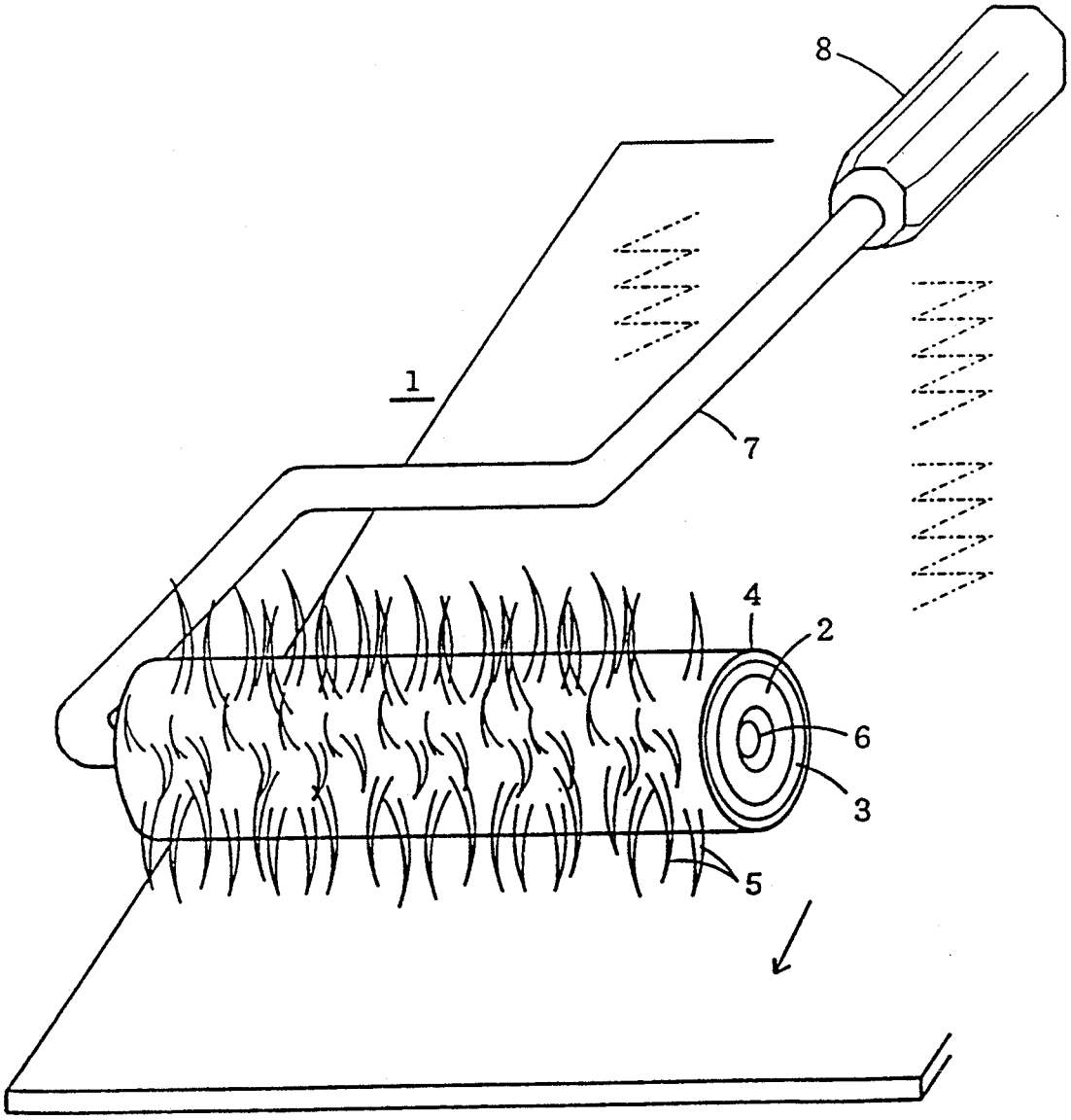
FIG. 1 is a perspective view illustrating an embodiment of the combination painting method using the combination roller of the invention.
Figure 2:
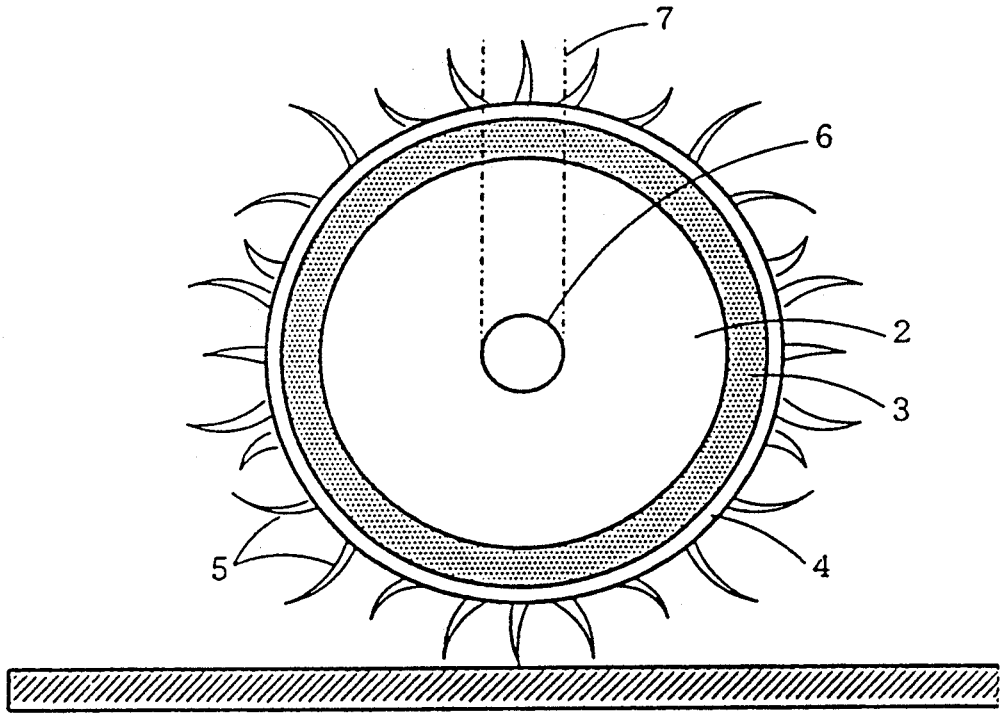
FIG. 2 is a sectional view of the roller of FIG. 1.

In FIG. 1 and FIG. 2, numeral 1 donotes a combination roller which is one of the distinctive features of the invention. The combination roller 1 comprises, from its core, an axle 6, a roller 2 which revolves around the axle 6, a cardboard 3 which is adhesively secured to the outer peripheral surface of the roller 2, a cheesecloth 4 which is adhesively secured to the outer peripheral surface of the cardboard 3, and a plurality of elastic sheets which are fixed upon the surface of the cheesecloth 4. Cloth comprising micrograss can be substituted for the cheesecloth 4.

Numeral 7 denotes an arm extending from one end of the axle 6 in a direction which is substantially perpendicular to the axle 6 of the roller 2, the tip of which has a handle 8 for manual operation.

Figure 3:
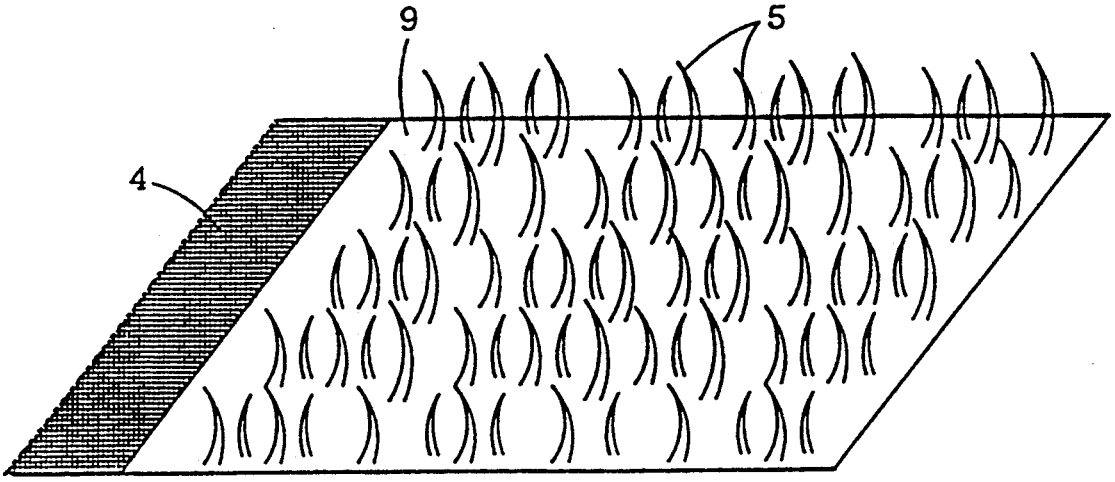
FIG. 3 is a development view of a cheesecloth used upon the roller of FIG. 1.
Figure 4:
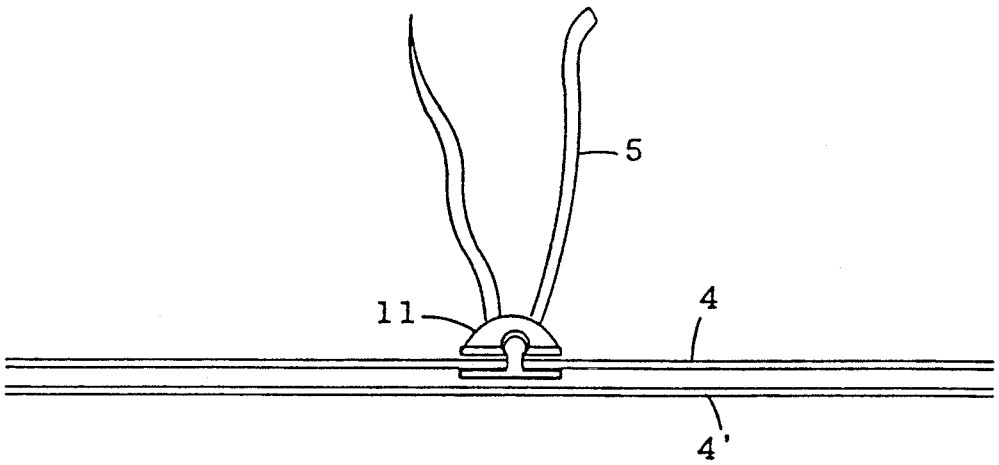
FIG. 4 and FIG. 5 are respectively a sectional view and a perspective view illustrating the fabrication of the elastic sheet.
Figure 5:
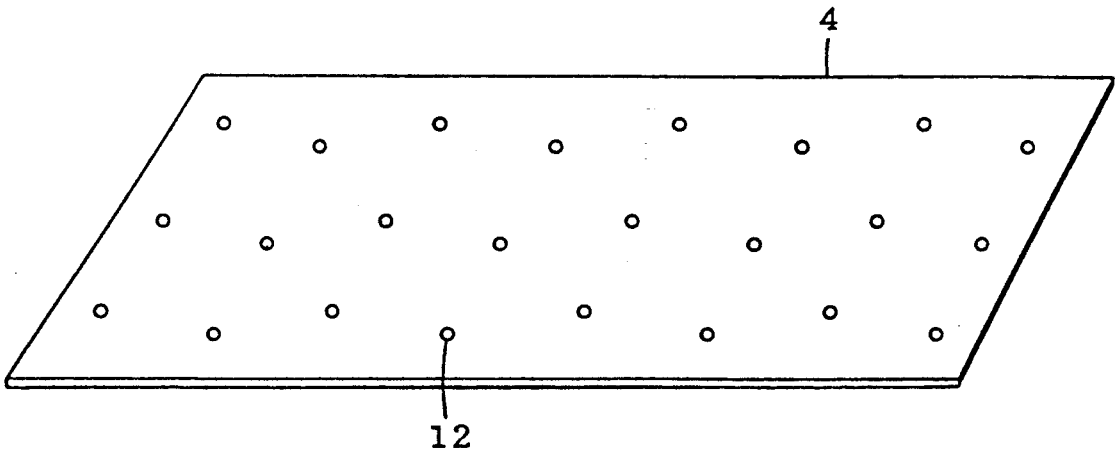

A rubber sheet, a flexible plastic sheet, or a fiber having a diameter of more than 0.5 mm, or the like, can be suitably used as the material for the elastic sheet 5. The elastic sheet 5 is secured upon the surface of the cheesecloth 4 by means of (1) sewing, (2) hooking, (3) an adhesive, or (4) joining by means of suitable lacing or the like. FIG. 3 shows that the elastic sheet 5 is secured upon the surface of the cheesecloth 4 by means of an epoxy adhesive 9. FIG. 4 shows that the elastic sheet 5 is fixed upon the cheesecloth 4 by means of a hook 11, and the hook 11 is secured by being sandwiched between cheesecloth 4 and a second cheesecloth 4'. FIG. 5 shows the cheesecloth 4 having a plurality of holes 12 for securing the hooks 11 easily therein.

A repeated pattern can be arranged by selecting the shape, size, securing position and spacing intervals defined between of the elastic sheets 5.

More particularly, as can be clearly seen from FIGS. 1-3 and 5, each of the sheets 5 actually comprises an elongated member having, for example, the predetermined diameter noted above, and wherein further, the spacing defined between the members 5 is at least greater than the predetermined diameter of each member 5.

Figure 6:
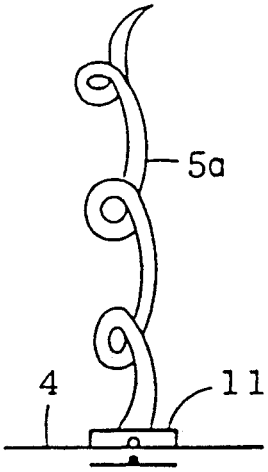
FIGS. 6 (a)~(p) are side views illustrating various kinds of shapes of the elastic sheet.
Figure 6:
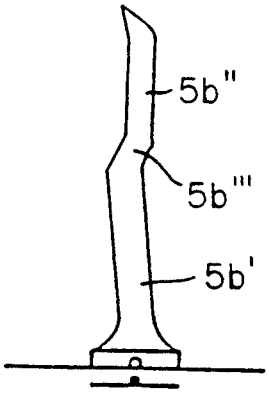
Figure 6:
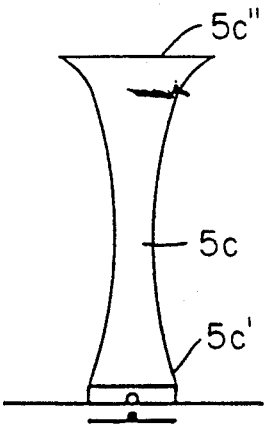
Figure 6:
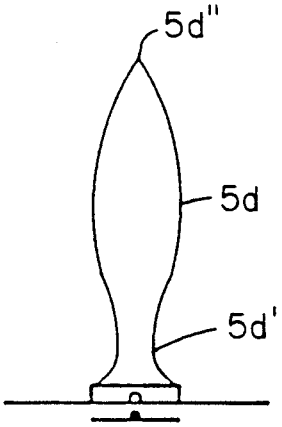
Figure 6:
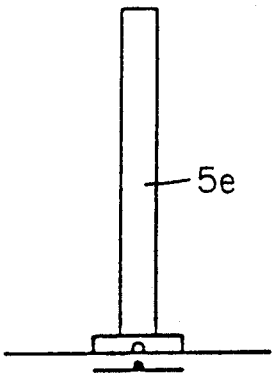
Figure 6:
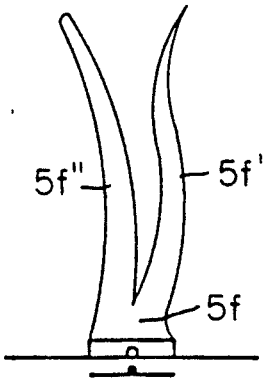
Figure 6:
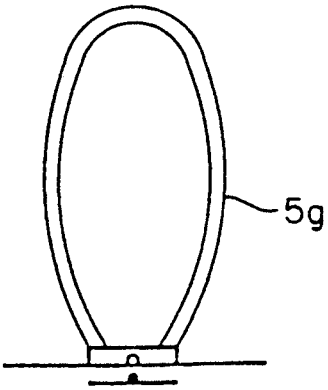
Figure 6:
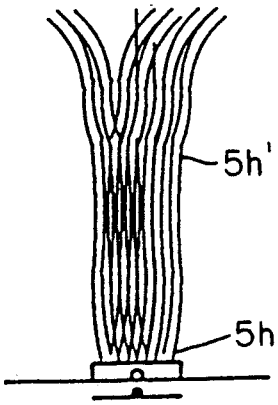
Figure 6I:
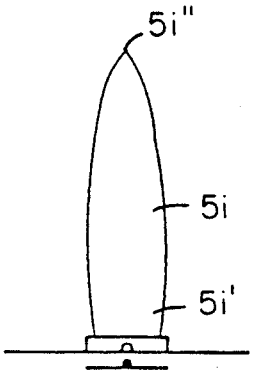
Figure 6J:
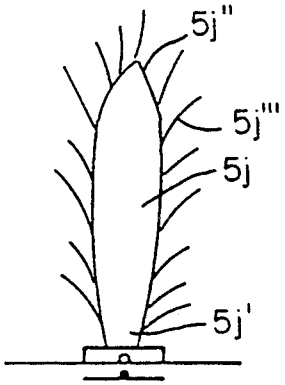
Figure 6K:
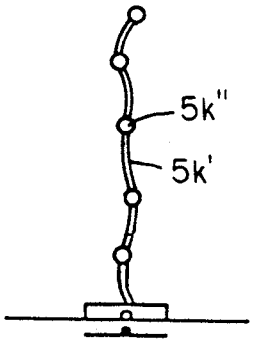
Figure 6L:
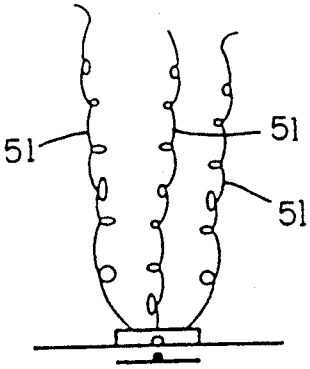
Figure 6M:
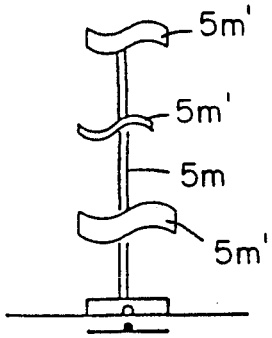
Figure 6N:
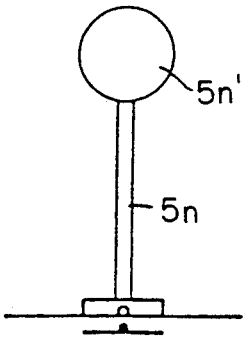
Figure 6O:
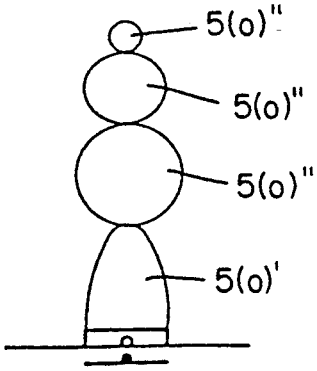
Figure 6P:
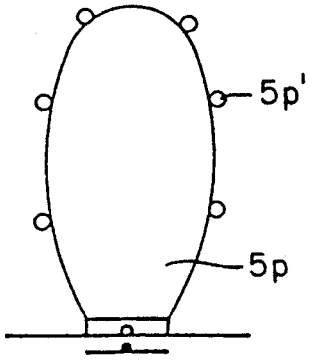

It is possible to adopt various kinds of shapes of sheets 5 as shown in FIGS. 6 (a)~(p) which in fact disclose sixteen (16) exemplary shapes of the elastic sheet 5. Tastefully repeated patterns can be respectively created.

More particularly, as seen in FIG. 6(*a*), each of the members 5 may comprise a substantially cylindrical member 5*a* which is curled or looped upon itself. In FIG. 6(*b*), the member comprises two axially extending portions 5*b'* and 5*b''* which are radially offset with respect to each other by means of a transition portion 5*b'''*. In FIG. 6(*c*), the member comprises a concavely tapered portion 5*c* which concavely tapers from a proximal end 5*c'* to a distal end 5*c''*, the latter of which is flattened. In FIG. 6(*d*), the member 5*d* has a substantially convexly tapered configuration, with, however, the proximal end portion 5*d'* being concavely tapered, and the distal end portion 5*d''* being pointed. In FIG. 6(*e*), the member 5*e* has a substantially cylindrical configuration. In FIG. 6(*f*), the primary member 5*f* is split within the vicinity of its proximal end portion into two portions 5*f''* and 5*f''*. In FIG. 6(*g*), the member has the configuration of an annular loop 5*g*. In FIG. 6(*h*), the primary member 5*h*, in a manner similar to that of member 5*f*, is split into a plurality or multiplicity of portions or secondary members 5*h'*. In FIG. 6(*i*), the member 5*i* simply gradually tapers from its proximal end 5*i'* toward its distal end 5*i''*, the latter of which is pointed. In FIG. 6(*j*), the primary member 5*j* is gradually tapered toward both its proximal end 5*j'* and its distal end 5*j''*, with the latter being pointed, and in addition, has secondary members 5*j'''* secured to peripheral or outer surface portions of the primary member 5*j*. In FIG. 6(*k*), the member comprises alternate cylindrical and spherical portions 5*k'* and 5*k''*, respectively. In FIG. 6(*l*), it is seen that the member comprises a plurality of members 5*l*, each of which is substantially similar to the single member 5*a* shown in FIG. 6(*a*) in that the same comprises a substantially cylindrical member curled or looped upon itself. In FIG. 6(*m*), it is seen that the member comprises a substantially cylindrical member 5*m* having transversely disposed secondary members 5*m'* secured thereto at axially spaced locations thereof. In FIG. 6(*n*), it is seen that the member comprises a substantially cylindrical portion 5*n* and a spherical portion 5*n'* secured to the distal end portion of cylindrical portion 5*n*. In FIG. 6(*o*), it is seen that the member comprises a semi-elliptical proximal portion 5(*o*)' and a plurality of successive spherical portions 5(*o*)'' having progressively smaller diametrical dimensions. Lastly, the member of FIG. 6(*p*) is seen to comprise a primary portion 5*p* having a substantially elliptical configuration, and a plurality of spherical portions 5*p'* secured to peripheral or outer surface portions of the primary portion 5*p*.

When painting outside or inside surfaces of the building for example, by using the combination roller of the invention, the combination roller 1 is inserted into a paint tub having paints of a suitable thickness, the paints are then adhered upon; the surface of the combination roller 1, and the combination roller 1 is revolved upon the surface to be painted upon which the first coating has been already finished. At this time, the combination roller 1 needs to be revolved at a sufficient speed such that the edge of each elastic sheet 5 is thrown by means of the centrifugal force against the surface to be painted. After a certain pattern is created as a result of rotation of the roller in a predetermined; revolving direction, the combination roller 1 is rotated in a different direction such as, for example; in a direction at right angles with respect to the original revolving direction. An evenly repeated pattern can thus be created.

When creating a colorful pattern, different paints are painted upon the painted surface using another combination roller.

After the first coating is completed by means of an epoxy adhesive holding a metal powder, a mica powder, or other reflecting material, or the like, and is hardened, the painting is then performed. A gorgeously painted surface can be created thereby.

Painted boards of various sizes can be created by revolving the combination roller 1 upon a continuous combination board at a sufficient speed such that the edge of each elastic sheet 5 is thrown outwardly onto the surface to be painted by means of; the centrifugal force.

The combination painting method using the combination roller of the invention constructed as above has the effect to be able to easily create complicated and colorful repetitive patterns without a high level of technology.

Obviously, many modifications and variations of the present invention are possible in light of the above teachings. It is therefore to be understood that within the scope of the appended claims, the present invention can be practiced otherwise than as specifically described herein.

What is claimed is:

1. A combination roller for painting surfaces, comprising:

an axle;

a roller rotatably mounted upon said axle; and a plurality of elastic members secured to said roller so as to extend substantially radially outwardly from peripheral surface portions of said roller and be thrown onto a surface to be painted under the influence of centrifugal force as said roller is rotated upon said axle, each of said elastic members having an elongated configuration and a predetermined diameter, and wherein further said plurality of elastic members are spaced from each other by means of a distance which is at least greater than said predetermined diameter of each one of said elastic members such that said plurality of elastic members form a repetitive pattern upon said roller.

2. A combination roller as set forth in claim 1, further comprising:

a cardboard tube fixedly secured about said roller; and a cheesecloth fixedly secured about said cardboard tube and upon which said plurality of elastic members are secured.

3. A combination roller as set forth in claim 1, further comprising:

an arm fixedly secured to said axle and having a portion thereof extending substantially perpendicular to an axis defined by said axle; and a handle secured to a distal end of said arm opposite a proximal end of said arm which is fixed to said axle.

4. A combination roller as set forth in claim 1, wherein:

each of said elastic members comprises a flexible plastic member.

5. A combination as set forth in claim 1, wherein:

each one of said elastic members comprises a rubber member.

6. A combination as set forth in claim 1, wherein:

each one of said elastic members comprises a fiber having a diameter greater than 0.5 mm.

7. A combination as set forth in claim 2, further comprising:

hook means for securing said elastic members to said cheesecloth; and a second cheesecloth cooperating with said cheesecloth for sandwiching said hook means therebetween.

8. A combination as set forth in claim 1, wherein:

each one of said plurality of members comprises a substantially cylindrical member which is curled upon itself.

9. A combination as set forth in claim 1, wherein:

each one of said plurality of members comprises a plurality of axially extending, radially offset portions interconnected together by means of a transition portion.

10. A combination as set forth in claim 1, wherein:

each one of said plurality of members comprises an axial, concavely tapered member.

11. A combination as set forth in claim 1, wherein:

each one of said plurality of members comprises an axial, convexly tapered member.

12. A combination as set forth in claim 1, wherein:

each one of said plurality of members comprises a substantially cylindrical member.

13. A combination as set forth in claim 1, wherein:

each one of said plurality of members comprises a member which is axially split into a plurality of axially extending members but which are connected together at a proximal portion thereof.

14. A combination as set forth in claim 1, wherein:

each one of said plurality of members comprises an annular loop.

15. A combination as set forth in claim 11, wherein:

each one of said plurality of convexly tapered members has a plurality of secondary members secured to peripheral surface portions of said convexly tapered members.

16. A combination as set forth in claim 1, wherein:

each one of said plurality of members comprises alternating cylindrical and spherical portions.

17. A combination as set forth in claim 12, wherein:

each one of said plurality of cylindrical members has transversely disposed secondary members secured thereto at axially spaced locations thereof.

18. A combination as set forth in claim 17, wherein:

each one of said plurality of cylindrical members has a spherical portion secured to a distal end portion thereof.

19. A combination as set forth in claim 1, wherein:

each one of said plurality of members comprises a proximal semi-elliptical member and a plurality of spherical members having progressively smaller diametrical dimensions as one proceeds toward the distal end of each one of said plurality of members.

20. A combination as set forth in claim 1, wherein:

each one of said plurality of members comprises an elliptical member having spherical members secured to peripheral outer surface portions thereof.

* * * * *